US007988339B2

(12) United States Patent
Chiang et al.

(10) Patent No.: US 7,988,339 B2
(45) Date of Patent: Aug. 2, 2011

(54) ILLUMINATION SYSTEM

(75) Inventors: Ya-Hui Chiang, Taoyuan (TW); Cheng-Da Shaw, Taipei (TW); Hung-Lieh Hu, Hsinchu (TW); Kuan-Chieh Tu, Taipei (TW)

(73) Assignee: Industrial Technology Research Institute, Hsinchu (TW)

( * ) Notice: Subject to any disclaimer, the term of this patent is extended or adjusted under 35 U.S.C. 154(b) by 315 days.

(21) Appl. No.: 12/429,976

(22) Filed: Apr. 24, 2009

(65) Prior Publication Data

US 2010/0135013 A1 Jun. 3, 2010

(30) Foreign Application Priority Data

Nov. 28, 2008 (TW) ..... 97146224 A

(51) Int. Cl.
*F21S 8/00* (2006.01)

(52) U.S. Cl. ..... 362/317; 362/319; 362/324; 362/341; 362/346

(58) Field of Classification Search ..... 362/317, 362/319, 324, 341, 347, 296.01, 297, 298, 362/296.08, 33, 217, 516, 517, 531
See application file for complete search history.

(56) References Cited

U.S. PATENT DOCUMENTS

| | | | | |
|---|---|---|---|---|
| 4,037,036 | A | 7/1977 | Mukoh et al. | |
| 5,436,807 | A * | 7/1995 | Kobayashi | 362/41 |
| 5,951,139 | A | 9/1999 | Smith et al. | |
| 6,099,147 | A | 8/2000 | Ziegenfuss | |
| 7,441,923 | B2 * | 10/2008 | Hunerbein et al. | 362/241 |
| 2006/0072313 | A1 | 4/2006 | Magarill | |
| 2010/0194276 | A1 * | 8/2010 | Okubo et al. | 315/82 |

FOREIGN PATENT DOCUMENTS

DE 102005035321 A1 2/2007

OTHER PUBLICATIONS

China Patent Office, Office Action, Patent Application Serial No. 200810186725.9, Mar. 16, 2011, China.

* cited by examiner

*Primary Examiner* — Evan Dzierzynski

(57) ABSTRACT

An illumination system includes at least one illumination module and a mechanism. The illumination module includes a light source generating a light beam, a first reflector, in which the light source is positioned, including a first reflective surface to reflect the light beam to form a first beam, and a second reflector including a second reflective surface reflecting the light beam and the first beam to form a second beam and a third beam, wherein the second and third beams combine to generate a projection pattern. The mechanism adjusts the position of the second reflector relative to the light source to change the projection pattern.

29 Claims, 6 Drawing Sheets

100

100

ILLUMINATION SYSTEM

CROSS REFERENCE TO RELATED APPLICATIONS

This Application claims priority of Taiwan Patent Application No. 97146224, filed on Nov. 28, 2008, the entirety of which is incorporated by reference herein.

BACKGROUND OF THE INVENTION

1. Field of the Invention

The invention relates to an illumination system, and in particular relates to an illumination system capable of changing a projection pattern by adjusting the positions of a reflector and a light source 2. Description of the Related Art For a conventional optical design, a secondary lens and a reflector are used to generate a desired projection pattern. The secondary lens cannot change a projection pattern without affecting the emitting efficiency. Additionally, the reflector cannot concentrate an emitting angle of the light beam to the range of 10 to 45 degrees.

U.S. Pat. No. 4,037,036 discloses an optical design with the function of filtering UV/IR light reflected by a reflector.

U.S. Pat. No. 5,951,139 discloses a conventional operation lamp comprising a light source, a reflector and mirrors. The light from the light source is reflected by the reflector. The reflected light is reflected by the mirrors to generate a projection pattern. The mirrors are disposed around a circle with respect to the center of the operation lamp.

US patent publication No. 2006/0072313 discloses an optical design for light emitting diodes comprising a light source and a reflector. The reflector can be a lens or a hollow reflector.

BRIEF SUMMARY OF INVENTION

A detailed description is given in the following embodiments with reference to the accompanying drawings.

An embodiment of the illumination system of the invention comprises at least one illumination module and a mechanism. The illumination module comprises a light source generating a light beam, a first reflector in which the light source is positioned comprising a first reflective surface to reflect the light beam to form a first beam, and a second reflector comprising a second reflective surface reflecting the light beam and the first beam to form a second beam and a third beam, wherein the second and third beams combine to generate a projection pattern. The mechanism adjusts the position of the second reflector relative to the light source to change the projection pattern.

An embodiment of an operating lamp of the invention comprises a plurality of illumination modules and a mechanism. Each illumination module comprises a light source generating a light beam, a first reflector in which the light source is positioned comprising a first reflective surface to reflect the light beam to form a first beam, and a second reflector comprising a second reflective surface reflecting the light beam and the first beam to form a second beam and a third beam, wherein the second and third beams combine to generate a projection pattern. The mechanism adjusts the position of the second reflector relative to the light source to change the projection pattern.

BRIEF DESCRIPTION OF DRAWINGS

The present invention can be more fully understood by reading the subsequent detailed description and examples with references made to the accompanying drawings, wherein.

DETAILED DESCRIPTION OF INVENTION

Figure 1:
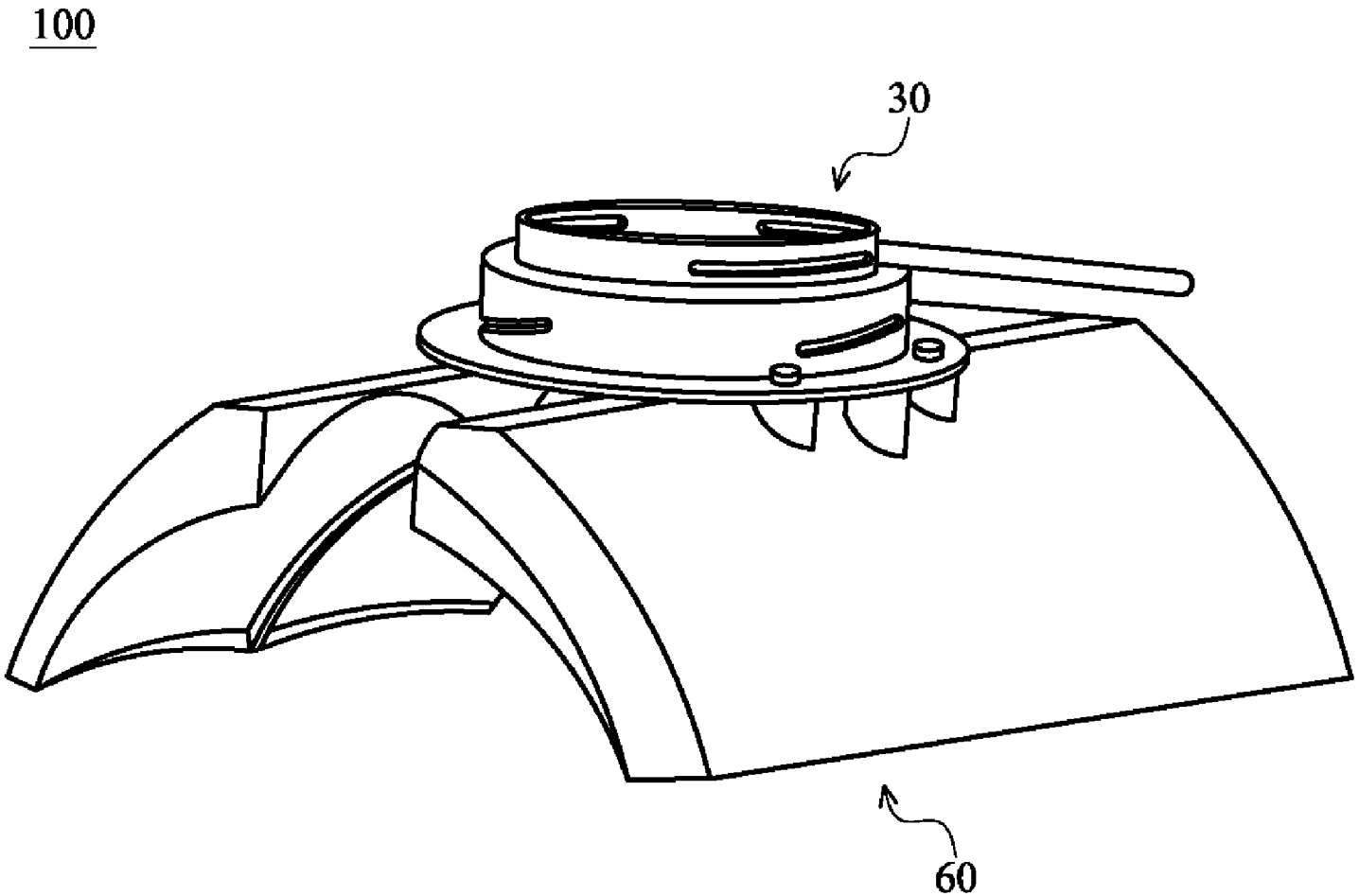
FIG. 1 is a perspective view of an embodiment of the illumination system of the invention.
Figure 2:
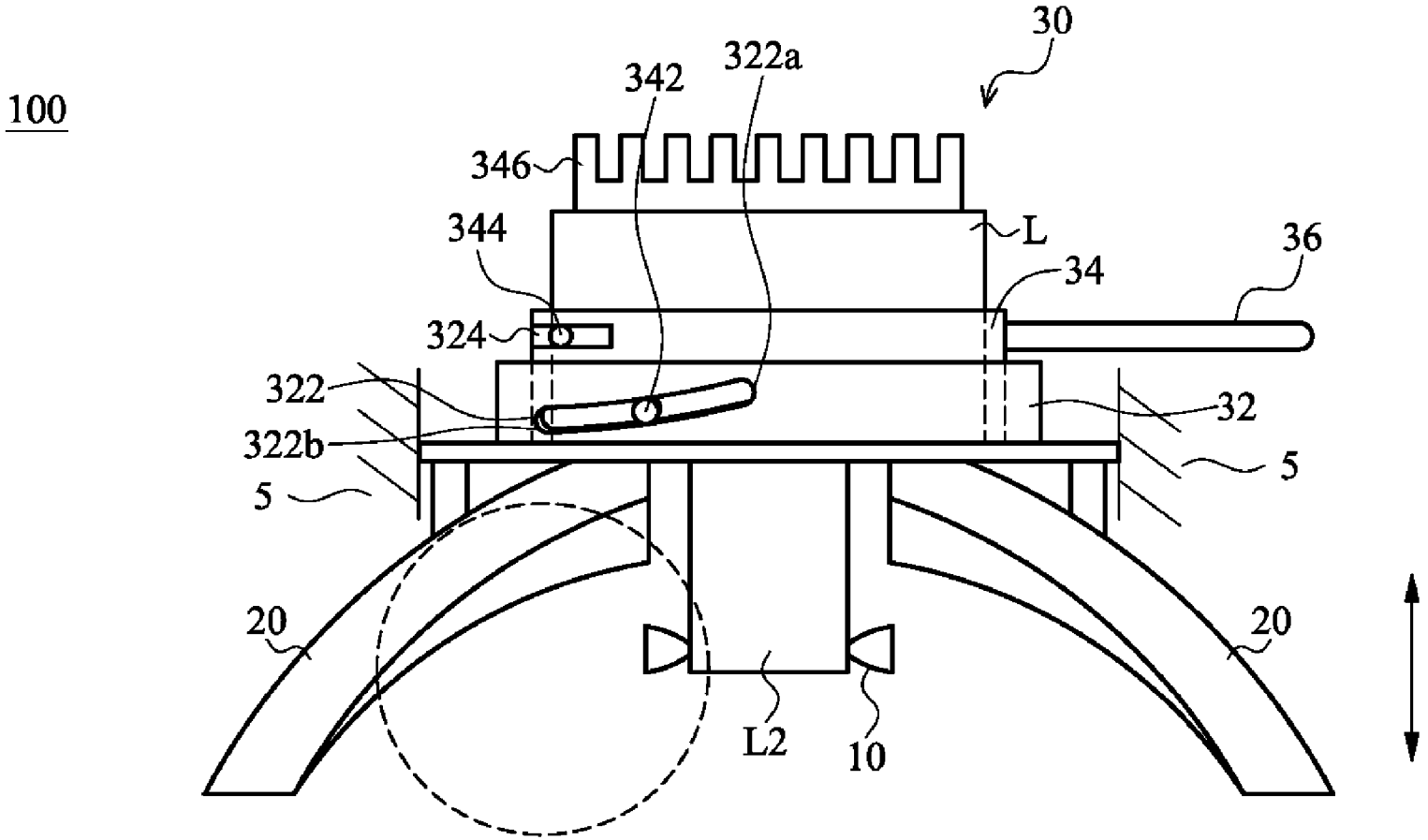
FIG. 2 is a side view of the illumination system of the invention.
Figure 3:
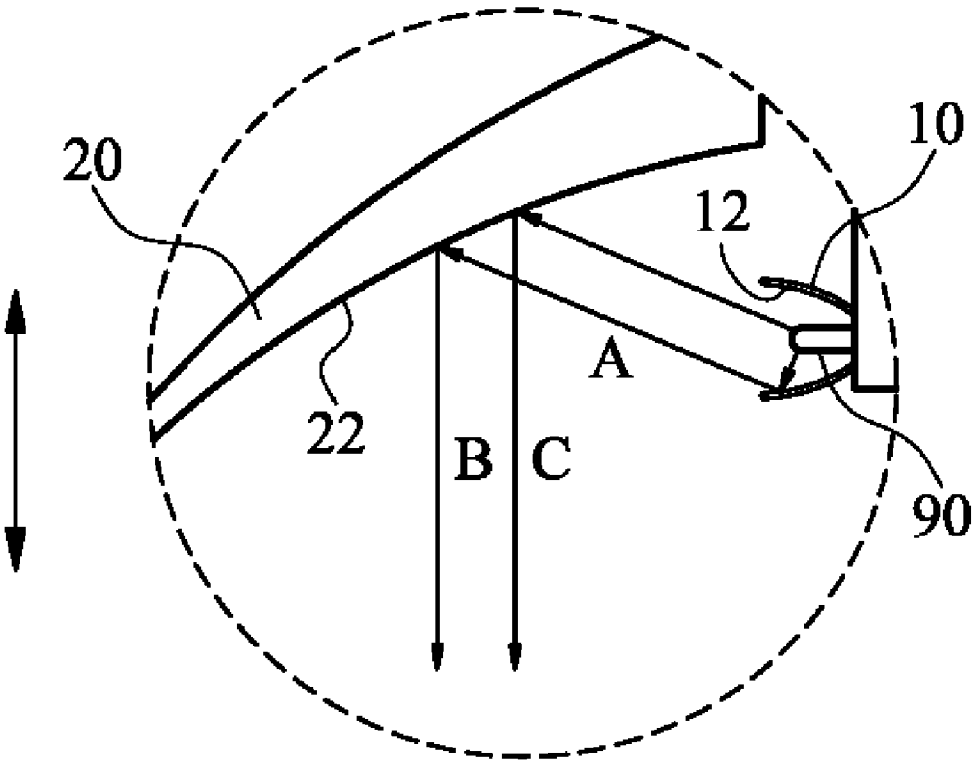
FIG. 3 is a schematic view of the illumination system of the invention.

An embodiment of the illumination system of the invention is shown in FIGS. 1 and 2. Referring to FIG. 1, the illumination system 100 comprises a plurality of illumination modules 60 and a mechanism 30. Referring to FIGS. 2 and 3, each illumination module 60 comprises a first reflector 10, a second reflector 20 and a light source 90.

The light source 90 is disposed in the first reflector 10, as shown in FIG. 3. The first reflector 10 comprises a first reflective surface 12. The second reflector 20 comprises a second reflective surface 22. There are two types of light beams from the light source 90. A first beam A is produced by a light beam reaching the first reflector 10 and being reflected by the first reflective surface 12 and a second beam B is produced by the first beam A being reflected by the second reflective surface 22 of the second reflector 20. The second type of light beam, a third beam C, is produced by the light beam reaching the second reflector 20 and being reflected by the second reflective surface 22. The second beam B and the third beam C form the desired projection pattern.

The first reflective surface 12 can be a curved surface, and in particular can be a parabolic surface or an elliptic surface, and the light source 90 can be disposed on the focus portion of the parabolic surface.

Similarly, the second reflective surface 22 can be a curved surface, and in particular can be a parabolic surface or an elliptic surface, and the light source 90 can be disposed on the focus portion of the parabolic surface.

The second reflectors 20 can be formed integrally or individually and are not limited to the structure and size in FIG. 1.

Referring to FIG. 2 again, the mechanism 30 moves the second reflector 20 to approach or move away from the light source 90, whereby the projection pattern is changed. The structure of the mechanism 30 is described as follows.

The mechanism 30 comprises a central shaft L, an extending portion L2 extending from the central shaft L, an outer tube 32, an inner tube 34 and a push rod 36. The light source 90 and the first reflector 10 are disposed on the extending portion L2. The outer tube 32 is disposed around the inner tube 34 and capable of moving thereon along the central shaft L. The push rod 36 is connected to the inner tube 34 capable of rotating around the central shaft L. One or some posts 342 are disposed on the periphery of the inner tube 34, and one or a few elongated grooves 322 are formed on the periphery of the outer tube 32. Each groove 322 has two ends 322*a* and 322*b* with different heights. The post 342 engages the groove 322 and moves between the ends 322*a* and 322*b*. When the push rod 36 is pushed, the inner tube 34 rotates around the central shaft L, and the post 342 also rotates and has relative motion with the groove 322. The lateral walls 5 constrain the outer tube 32 to move along the central shaft L. Since the second reflector 20 is connected to the outer tube 32, when the outer tube 32 moves, the second reflector 20 moves, whereby the second reflector 20 approaches or moves away from the first reflector 10 and the light source 90 to change the projection pattern. The grooves 322 can also be spiral, and the push rod 36 can be integrally formed with the inner tube 34.

To ensure that the central shaft L rotates without linear movement and limit the rotation range of the push rod 36, two or more posts 344 are disposed on the periphery of the central shaft L. A groove 324 is formed on the inner tube 34. The post 344 engages the groove 324 and can move therein. When the push rod 36 rotates to abut the end of the groove 324, the push rod 36 stops, whereby the inner tube 34 stop rotating.

Although the distance between the second reflector 20 and the light source 90 is changed by moving the second reflector 20 in the described embodiment, the distance can also be changed by moving the light source 90.

Figure 4:
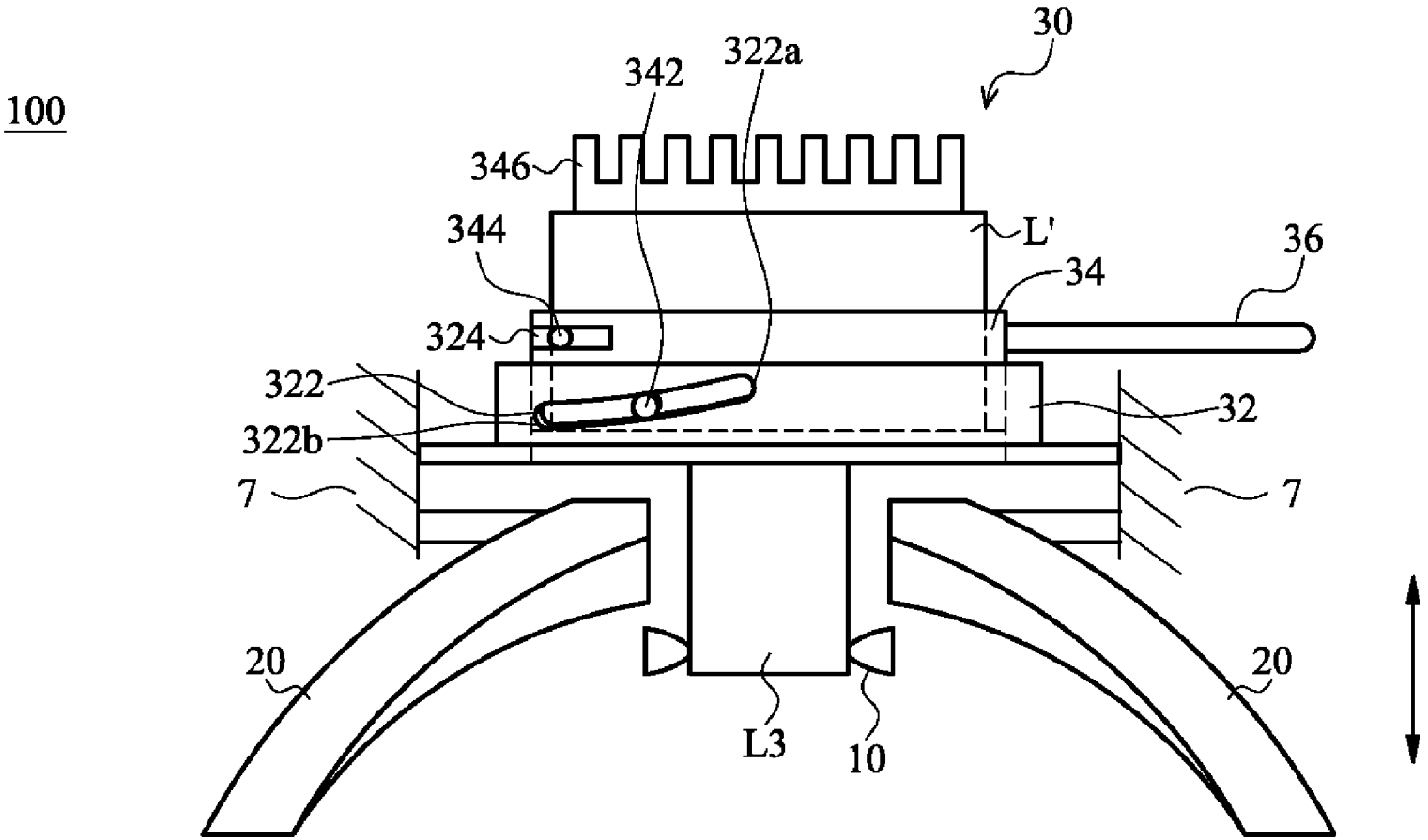
FIG. 4 is a side view of another embodiment of the illumination system of the invention.

FIG. 4 depicts another embodiment of the illumination system of the invention. Referring to FIG. 4, the second reflector 20 is fixed to a wall 7. The light source 90 and the first reflector 10 are fixed to a sub-base L3 which is joined to the outer tube 32. When the outer tube 32 moves, the light source 90 moves up and down to approach or move away from the second reflector 20 to change the projection pattern.

Figure 5:
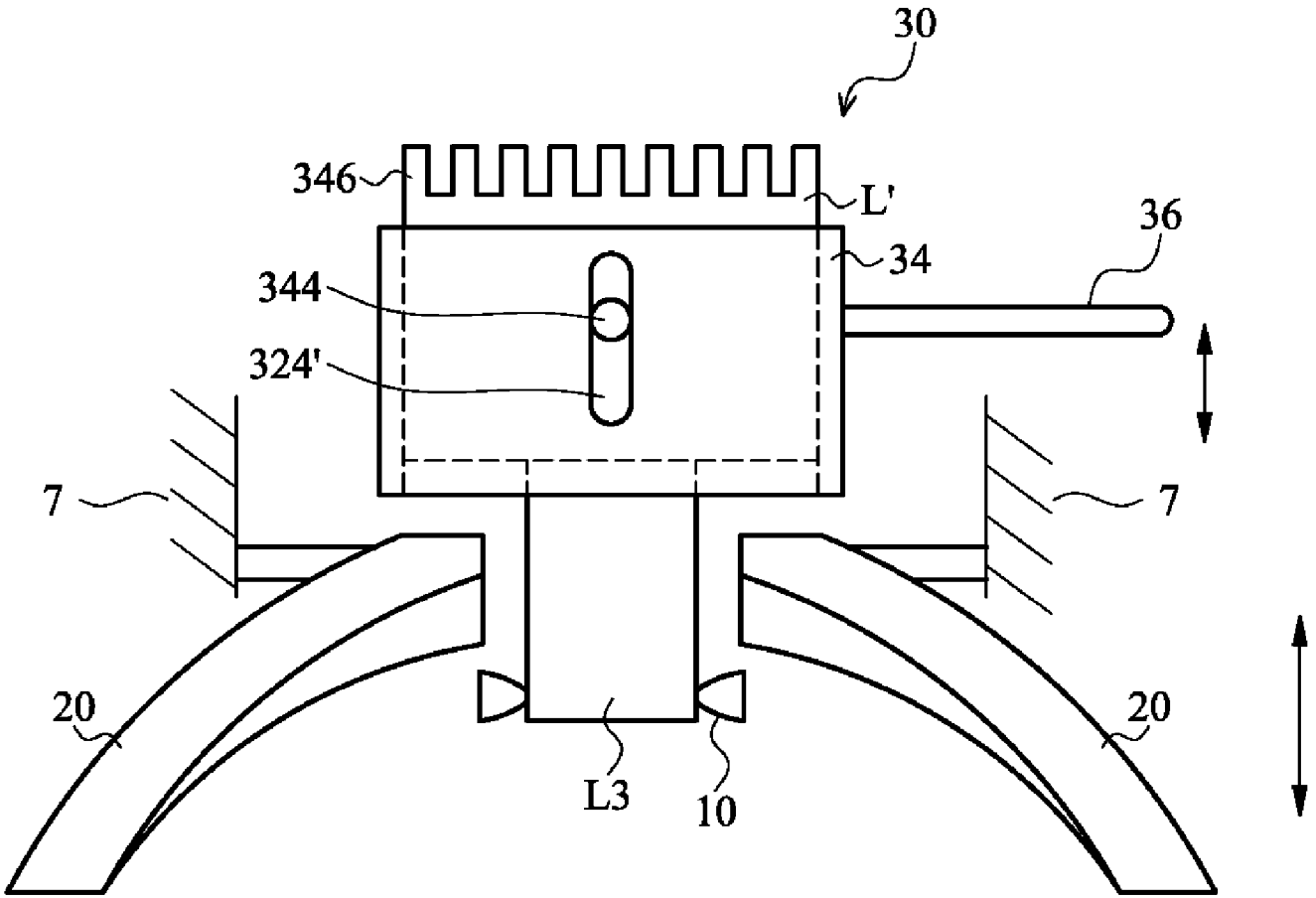
FIG. 5 is a side view of another embodiment of the illumination system of the invention.

FIG. 5 depicts another embodiment of the illumination system of the invention. Referring to FIG. 5, compared with the embodiment of FIG. 4, the outer tube 32 is eliminated. A groove 324' vertically extends on the inner tube 34. A post 344 is disposed on the periphery of the central shaft L'. The inner tube 34 is constrained by the post 344 engaging the groove 324' to move vertically. A sub-base L3 is connected to the inner tube 34. In the embodiment, as the push rod 36 is joined to the inner tube 34, the inner tube 34 is moved by pushing the push rod 36. Because the sub-base L3 is joined to the inner tube 34, the sub-base L3 is moved by the inner tube 34, whereby the light source 90 and the first reflector 10 on the sub-base L3 moves relative to the second reflector 20 to change the projection pattern.

Figure 6:
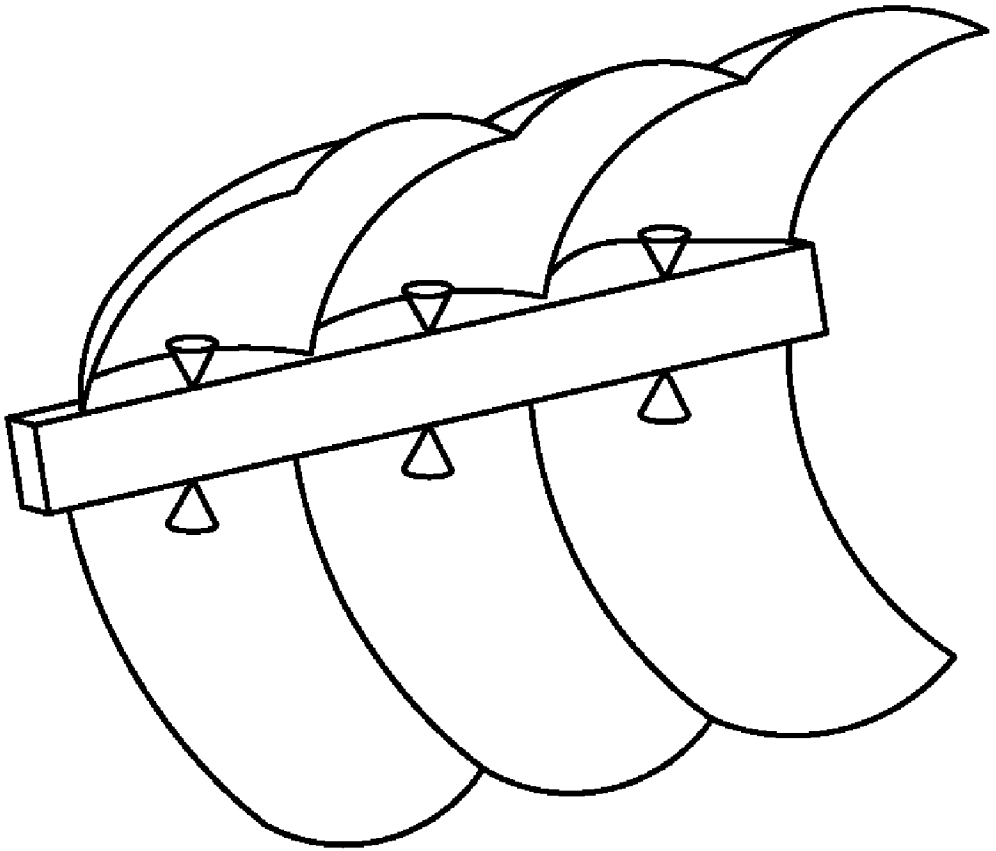
FIG. 6 depicts the application of the illumination system of the invention.

The invention provides a new design for illumination system used in medicine. The new structure comprises two reflectors and one light source. One of the reflectors can move relative to the light source to change projection pattern so as to prevent shadow and blinding effect. FIG. 6 depicts an illumination system comprising six illumination modules. For dental operations, more than four illumination modules are desired. For general operations, 20 or more illumination modules are used to generate a projection pattern without shadow and blinding effect.

In addition, to dissipate heat from the light source 90, a heat dissipation device 346 is disposed on the central shaft (L or L'). The heat dissipation device 346 can be integrally formed with the central shaft (L or L').

While the invention has been described by way of example and in terms of embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An illumination system, comprising at least one illumination module comprising:

a light source generating a light beam;

a first reflector in which the light source is positioned comprising a first reflective surface to reflect the light beam to form a first beam; and a second reflector comprising a second reflective surface reflecting the light beam and the first beam to form a second beam and a third beam, wherein the second and third beams combine to generate a projection pattern; and a mechanism adjusting the position of the second reflector relative to the light source to change the projection pattern.

2. The illumination system as claimed in claim 1, wherein the light source is a light emitting diode.

3. The illumination system as claimed in claim 1, wherein the second reflective surface is a parabolic surface or an elliptic surface.

4. The illumination system as claimed in claim 3, wherein the light source is positioned on the focus portion of the parabolic surface.

5. The illumination system as claimed in claim 1, wherein the first reflector is a curved surface mirror.

6. The illumination system as claimed in claim 1, wherein the mechanism comprises:

a base comprising a central shaft and an extending portion extending from the central shaft, and the light source and the first reflector are positioned on the extending portion;

an inner tube positioned around the central shaft;

an outer tube positioned around the inner tube and the second reflector is positioned on the outer tube; and a push rod connected to the inner tube, wherein the push rod is pushed to rotate the inner tube so as to move the outer tube, whereby the second reflector approaches or moves away from the light source.

7. The illumination system as claimed in claim 6, wherein the outer tube is constrained by a lateral wall of the base and unable to rotate.

8. The illumination system as claimed in claim 7, wherein the outer tube has at least one groove having two ends with different heights, and the groove has a narrow shape.

9. The illumination system as claimed in claim 7, wherein the outer tube has a groove having a spiral shape.

10. The illumination system as claimed in claim 6, wherein the inner tube has at least one post engaging the groove, and when the inner tube rotates, the post moves along the groove to move the outer tube, whereby the second reflector approaches or moves away from the light source.

11. The illumination system as claimed in claim 6 further comprising a heat dissipation module connected to the central shaft.

12. The illumination system as claimed in claim 11, wherein the heat dissipation module is integrally formed with the central shaft.

13. The illumination system as claimed in claim 1, wherein the mechanism moves the second reflector to adjust the position of the second reflector relative to the light source to change the projection pattern.

14. The illumination system as claimed in claim 1, wherein the mechanism moves the light source to adjust the position of the light source relative to the second reflector to change the projection pattern.

15. The illumination system as claimed in claim 1, wherein the mechanism comprises:

a base comprising a central shaft and a wall on which the second reflector is disposed;

an inner tube positioned around the central shaft;

an outer tube positioned around the inner tube;

a sub-base disposed on the outer tube, and the light source and the first reflector being disposed on the sub-base; and a push rod connected to the inner tube, wherein the push rod is pushed to rotate the inner tube so as to move the outer tube along the central shaft, whereby the light source approaches or moves away from the second reflector.

16. The illumination system as claimed in claim 1, wherein the mechanism comprises:

a base comprising a central shaft and a wall on which the second reflector is disposed;

an inner tube positioned around the central shaft;

a sub-base disposed on the inner tube, the light source and the first reflector being disposed on the sub-base; and a push rod connected to the inner tube, wherein the push rod is pushed to rotate the inner tube so as to move the sub-base along the central shaft, whereby the light source approaches or moves away from the second reflector.

17. The illumination system as claimed in claim 16, wherein the inner tube has a groove, and the central shaft has a post movably engaging the groove, and when the push rod is pushed to move the inner tube, the sub-base is constrained by the movement of the base.

18. An operating lamp, comprising:

a plurality of illumination modules, wherein each illumination module comprises:

a light source generating a light beam;

a first reflector in which the light source is positioned comprising a first reflective surface to reflect the light beam to form a first beam; and a second reflector comprising a second reflective surface reflecting the light beam and the first beam to form a second beam and a third beam, wherein the second and third beams combine to generate a projection pattern; and a mechanism adjusting the position of the second reflector relative to the light source to change the projection pattern.

19. The operating lamp as claimed in claim 18, wherein the light source is a light emitting diode.

20. The operating lamp as claimed in claim 18, wherein the second reflective surface is a parabolic surface or an elliptic surface.

21. The operating lamp as claimed in claim 20, wherein the light source is positioned on the focus portion of the parabolic surface.

22. The operating lamp as claimed in claim 18, wherein the first reflector is a curved surface mirror.

23. The operating lamp as claimed in claim 18, wherein the mechanism comprises:

a base comprising a central shaft and an extending portion extending from the central shaft, and the light source and the first reflector are positioned on the extending portion;

an inner tube positioned around the central shaft;

an outer tube positioned around the inner tube and the second reflector is positioned on the outer tube; and a push rod connected to the inner tube, wherein the push rod is pushed to rotate the inner tube so as to move the outer tube along the central shaft, whereby the second reflector approaches or moves away from the light source.

24. The operating lamp as claimed in claim 23, wherein the outer tube has at least one spiral groove, and the inner tube has at least one post engaging the spiral groove, and when the inner tube rotates, the outer tube moves, whereby the second reflector approaches or moves away from the light source.

25. The operating lamp as claimed in claim 23 further comprising a heat dissipation module connected to the central shaft.

26. The operating lamp as claimed in claim 25, wherein the heat dissipation module is integrally formed with the central shaft.

27. The operating lamp as claimed in claim 18, wherein the mechanism comprises:

a base comprising a central shaft and a wall on which the second reflector is disposed;

an inner tube positioned around the central shaft;

an outer tube positioned around the inner tube;

a sub-base disposed on the outer tube, and the light source and the first reflector being disposed on the sub-base; and a push rod connected to the inner tube, wherein the push rod is pushed to rotate the inner tube so as to move the outer tube along the central shaft, whereby the light source approaches or moves away from the second reflector.

28. The operating lamp as claimed in claim 18, wherein the mechanism comprises:

a base comprising a central shaft and a wall on which the second reflector is disposed;

an inner tube positioned around the central shaft;

a sub-base disposed on the inner tube, and the light source and the first reflector being disposed on the sub-base; and a push rod connected to the inner tube, wherein the push rod is pushed to rotate the inner tube so as to move the sub-base along the central shaft, whereby the light source approaches or moves away from the second reflector.

29. The operating lamp as claimed in claim 28, wherein the inner tube has a groove, and the central shaft has a post movably engaging the groove, and when the push rod is pushed to move the inner tube, the sub-base is constrained by the movement of the base.

* * * * *